US006299461B1

(12) United States Patent
Zhu et al.

(10) Patent No.: US 6,299,461 B1
(45) Date of Patent: Oct. 9, 2001

(54) ELECTRICAL CONNECTOR HAVING A FIXING DEVICE

(75) Inventors: Corel Zhu, Jin-Tang; Guo-Hua Chang; Chang-Xiu Du, both of Kun-Shan, all of (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/296,859

(22) Filed: Apr. 22, 1999

(30) Foreign Application Priority Data

Nov. 24, 1998 (TW) ..... 87219535

(51) Int. Cl.[7] ..... H01R 12/00
(52) U.S. Cl. ..... 439/76.1; 439/607; 439/567
(58) Field of Search ..... 439/79, 82, 83, 439/876, 101, 108, 80, 541.5, 567

(56) References Cited

U.S. PATENT DOCUMENTS 5,295,867 * 3/1994 Bethurum ..... 439/607
5,451,158 * 9/1995 Lin et al. ..... 439/79
5,470,259 * 11/1995 Kaufman ..... 439/607
5,711,678 * 1/1998 Wu ..... 439/79
5,975,917 * 11/1999 Wang et al. ..... 439/79
5,989,041 * 11/1999 Lin ..... 439/79

* cited by examiner

*Primary Examiner*—Brian Sircus
*Assistant Examiner*—J. F. Duverne
(74) *Attorney, Agent, or Firm*—Wei Te Chung

(57) ABSTRACT

An electrical connector comprises an insulative housing (3), a number of terminals (4), two rivets and a fixing device (5). The housing (3) forms a D-sub projection (31) defining a number of passageways (32). The fixing device (5) engages with the housing (3) by rivets. The fixing device (5) has four boardlocks (51) extending through a circuit board (6) to suspend the housing (3) beyond an edge of the circuit board (6). Thus, occupied space on circuit board (6) can be conserved.

3 Claims, 4 Drawing Sheets

ELECTRICAL CONNECTOR HAVING A FIXING DEVICE

BACKGROUND OF THE INVENTION

The present invention relates to an electrical connector, and particularly to an electrical connector having a rear fixing device for mounting the electrical connector to main circuit board whereby a height of the electrical connector on the circuit board can be reduced.

Taiwan Patent Application Nos. 81213628 and 83200254 disclose conventional connectors which are mounted on the circuit board by means of boardlocks. Referring to FIG. 1, the conventional electrical connector has an insulative housing 1, an engaging projection 11 extending from a front side of the housing 1, and a plurality of passageways 12 defined in the housing 1 for receiving a plurality of terminals 13. A tail portion of each terminal 13 extends rearwardly for being mounted on a circuit board. A fixing device 2 positioned at lateral ends of the housing 1 fixes the electrical connector to the circuit board, by means of rivets 22. The conventional electrical connector is entirely mounted on the circuit board by a locking section 21. Thus the electrical connector occupies too much space and exhibits a high profile on the circuit board.

BRIEF SUMMARY OF THE INVENTION

A main object of the present invention is to provide an electrical connector having a rear fixing device for suspending the connector away from a circuit board thereby facilitating an efficient use of circuit board space through its low profile.

To fulfill the above-mentioned object, according to a preferred embodiment of present invention, an electrical connector comprises a housing, a plurality of terminals, two rivets and a fixing device. The housing defines a plurality of passageways for receiving the terminals. The fixing device is mounted to a rear face of the housing by the rivets. The fixing device includes four boardlocks which extend through a circuit board and suspend the housing beyond an edge of the circuit board. Thus, an efficient use of circuit board space is promoted and the proper position of the terminals can be maintained.

Other objects, advantages and novel features of the invention will become more apparent from the following detailed description when taken in conjunction with the accompanying drawings.

DETAILED DESCRIPTION OF THE INVENTION

Figure 1:
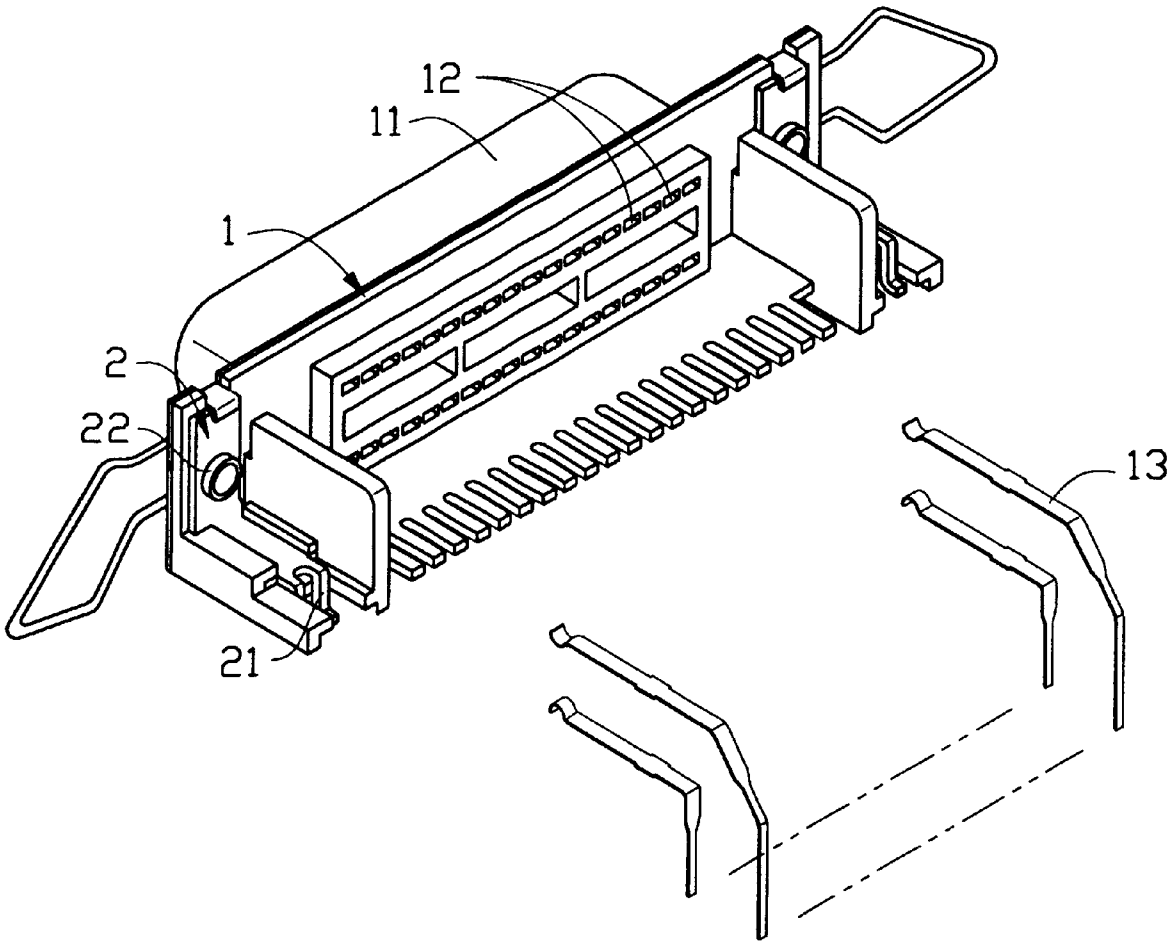
FIG. 1 (PRIOR ART)
FIG. 1 is a perspective view of a conventional electrical connector.
Figure 2:
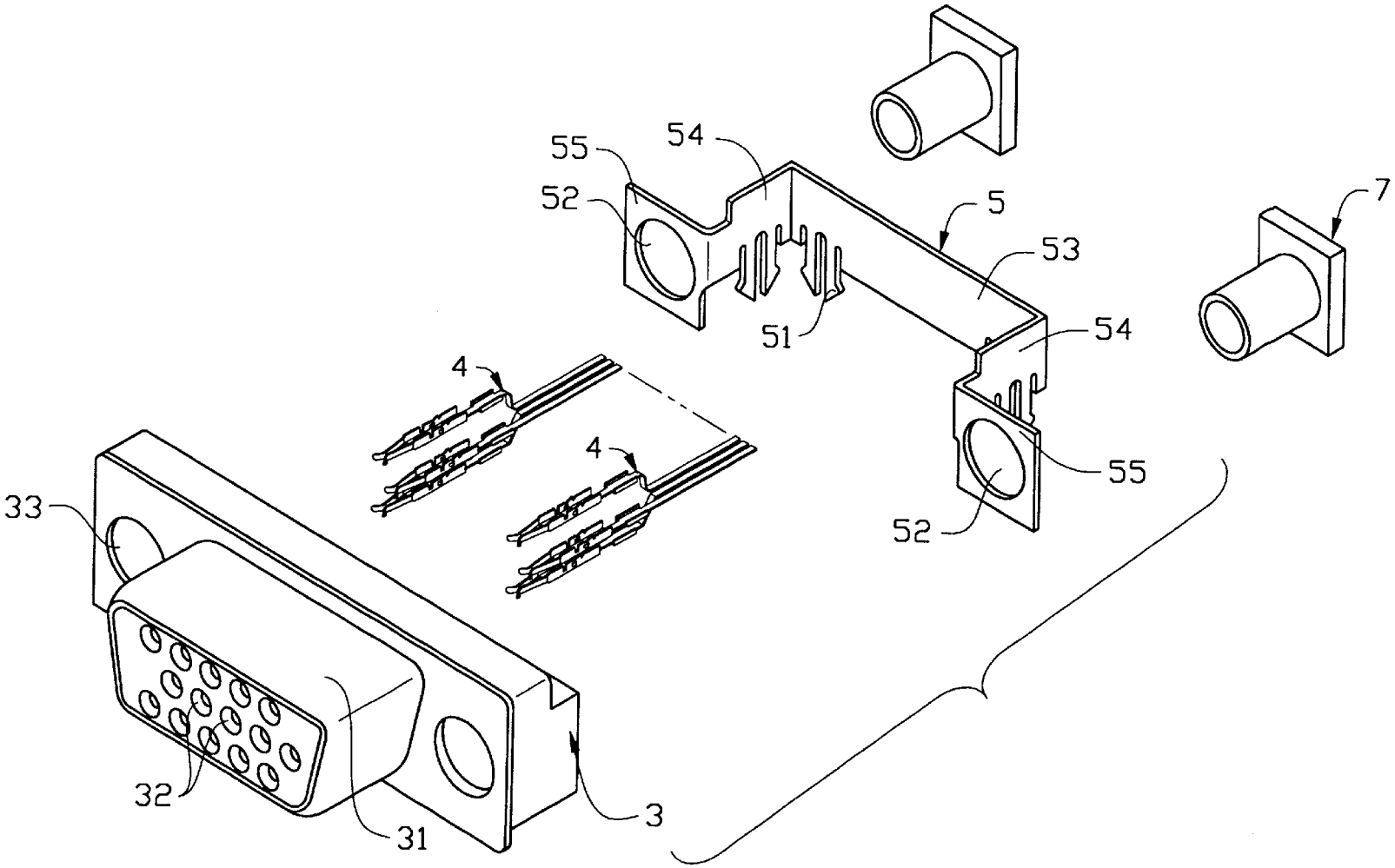
FIG. 2 is an exploded view of an electrical connector in accordance with the present invention.
Figure 3:
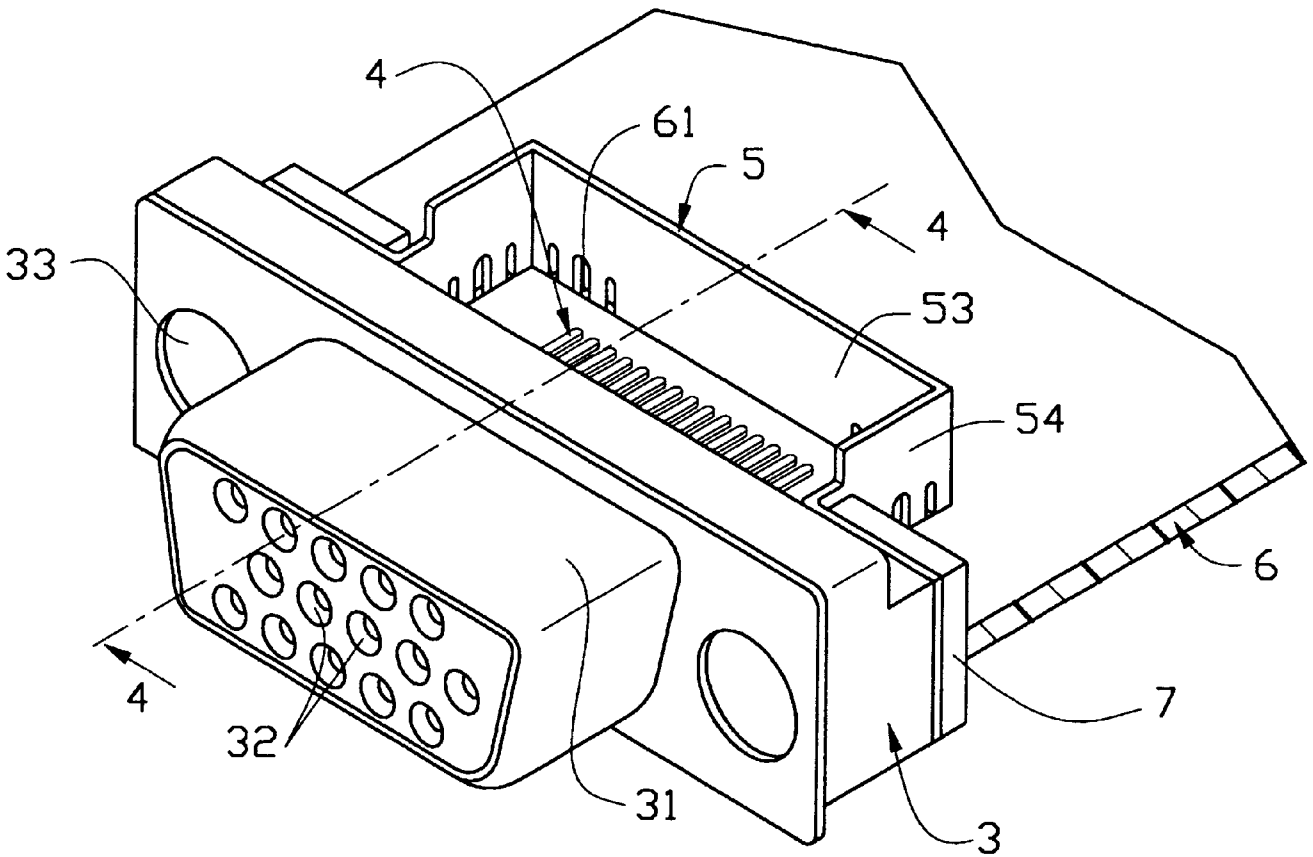
FIG. 3 is a perspective view of the assembled electrical connector attached to a circuit board.

Referring to FIG. 2, an electrical connector comprises an insulative housing 3 having a D-sub projection 31 extending from a front side thereof for engaging with a mating electrical device (not shown). The D-sub projection 31 defines a plurality of passageways 32 for receiving a plurality of terminals 4. One end of each terminal 4 extends through the D-sub projection 31 for engaging with corresponding contacts of the mating electrical device, and the other end of each terminal 4 extends beyond the housing 3 for being mounted to a circuit board 6 (FIG. 3). A pair of holes 33 is defined in opposite lateral portion of the housing 3 for receiving two rivets (not shown).

A fixing device 5 is positioned on a rear side of the housing 3. The fixing device 5 is folded to have a U-shape. A pair of holes 52 is provided in corresponding folded plate 55 at opposite ends of the fixing device 5 for receiving riveting nuts 7. Thus, the riveting nuts 7 can mount the fixing device 5 to the housing 3. The fixing device 5 has a plurality of boardlocks 51 extending therefrom in the same direction. In the embodiment shown, two boardlocks 51 are positioned along a bottom edge of a longitudinal side wall 53 parallel to the insulative housing, another two boardlocks are positioned on a bottom edge of opposite lateral side walls 54.

Figure 4:
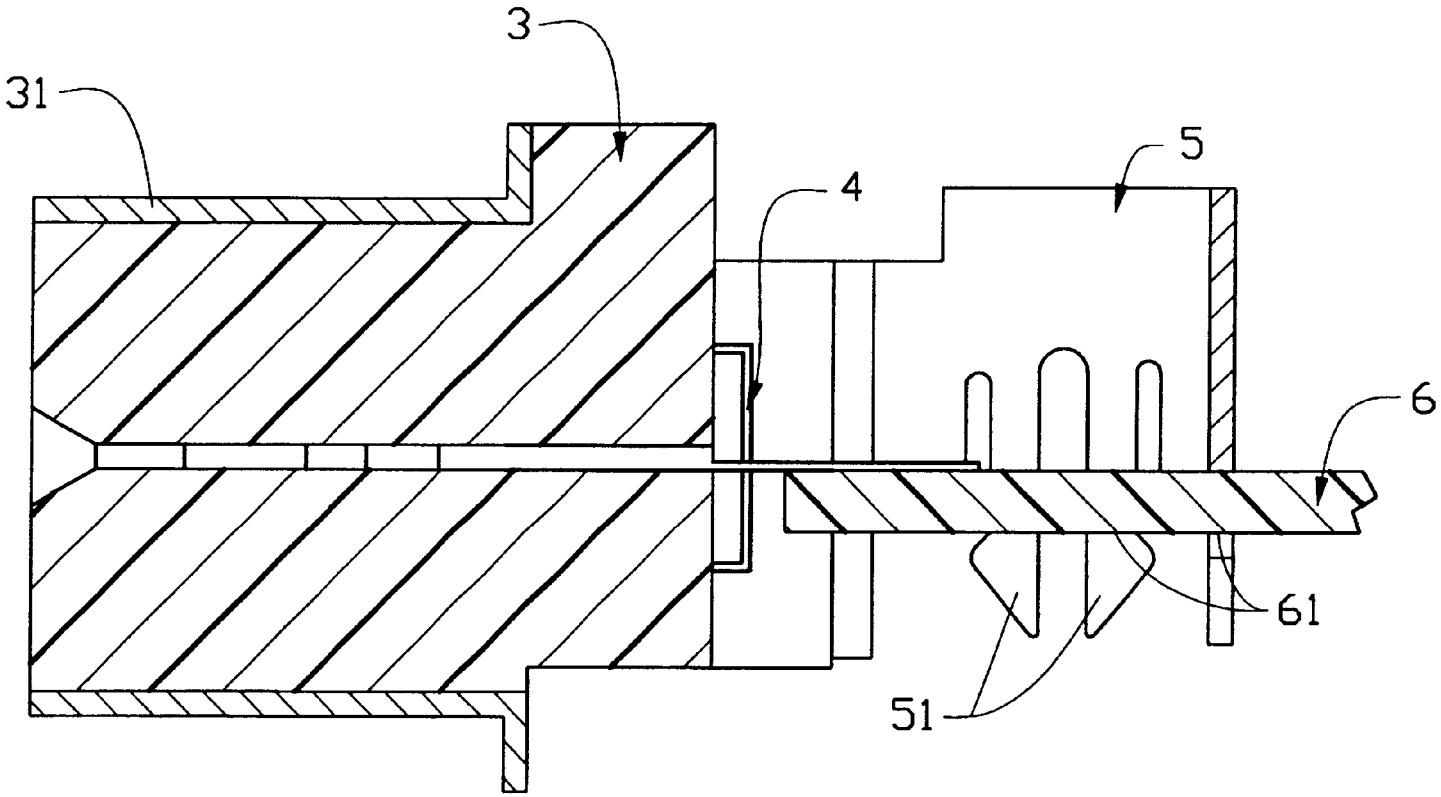
FIG. 4 is a cross-sectional view taken along line 4—4 of FIG. 3.

Referring to FIGS. 3 and 4, the fixing device 5 is mounted to the housing 3 by firstly aligning the holes 52 of the fixing device 5 with the holes 33 of the housing 3, and then interferentially extending the riveting nuts 7 through the holes 52, 33. The riveting nut 7 has a quadrate block (not labeled) fixedly engages a rear face of a corresponding folded plate 55 of the fixing device 5. The connector is mounted to the circuit board 6 by inserting the boardlocks 51 through holes 61 defined in the circuit board 6, whereby the terminals 4 electrically connect with corresponding circuits of the board 6. Since the boardlocks 51 are mounted away from the insulative housing 3, when the boardlocks 51 engage with the holes 61, the electrical connector will be suspended beyond an edge of the circuit board 6 thereby conserving space occupied on the circuit board 6. The position of the electrical connector can be adjusted by defining the holes 61 at different positions on the circuit board 6. In addition, the fixing device 5 surrounds the terminals 4 to protect the terminals 4 from the effects of electromagnetic interference. Furthermore, when the boardlocks 51 engage with the holes 61 of the circuit board 6, the terminals 4 are aligned in a plane thereby ensuring reliable signal transmission. Finally, most clear from FIG. 4, as the connector is suspended beyond an edge of the board 6, a lower portion of the connector can be located below the board 6 to cause the connector to have a low profile above the board 6.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing having a plurality of passageways;

a plurality of terminals received in the passageways, each terminal having a front end positioned in the passageway for engaging with a contact of a mating connector and a rear end extending beyond the housing for soldering to a circuit board; and a fixing device for fixing the connector relative to the circuit board being secured to the housing and comprising a metal folded plate having a first side wall and two opposite second side walls perpendicular to the first side wall for enclosing the rear ends of the terminals, and a plurality of boardlocks integrally formed on both the first and second side walls and supporting the insulative housing in a position fully outside the circuit board.

2. The electrical connector as claimed in claim 1, wherein the fixing device has four boardlocks, two of the four boardlocks being positioned parallel to the insulative housing on the first side wall, the other two boardlocks being respectively positioned on each of the two opposite second side walls.

3. The electrical connector as claimed in claim 1, wherein a pair of holes are defined in opposite lateral sides of the housing, and two riveting nuts engage with the holes to mount the fixing device to the housing.

* * * * *